US009963310B2

(12) United States Patent
Hanamoto

(10) Patent No.: US 9,963,310 B2
(45) Date of Patent: May 8, 2018

(54) SHEET FEEDER THAT ENSURES EXECUTION OF SHEET FEEDING WITH MORE CERTAINTY BY FEEDING RETRY PROCESS AND IMAGE PROCESSING APPARATUS INCLUDING THE SAME

(71) Applicant: KYOCERA Document Solutions Inc., Osaka (JP)

(72) Inventor: Katsuhiko Hanamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/454,583

(22) Filed: Mar. 9, 2017

(65) Prior Publication Data

US 2017/0297838 A1 Oct. 19, 2017

(30) Foreign Application Priority Data

Apr. 15, 2016 (JP) ..... 2016-081735

(51) Int. Cl.
*B65H 3/06* (2006.01)

(52) U.S. Cl.
CPC ..... *B65H 3/0607* (2013.01); *B65H 3/0684* (2013.01); *B65H 2404/1521* (2013.01)

(58) Field of Classification Search
CPC ..... B65H 3/0607; B65H 3/0684; B65H 2404/1521
USPC ..... 271/117, 118, 121
See application file for complete search history.

(56) References Cited

U.S. PATENT DOCUMENTS 5,816,569 A * 10/1998 Hoshi ..... B65H 3/5261 271/117
7,530,563 B2 * 5/2009 Kuo ..... B65H 3/0684 271/117
8,517,373 B2 * 8/2013 Harada ..... B65H 3/0684 271/117

FOREIGN PATENT DOCUMENTS

JP 2013-119469 A 6/2013

* cited by examiner

*Primary Examiner* — Michael C McCullough
(74) *Attorney, Agent, or Firm* — Stein IP, LLC

(57) ABSTRACT

A sheet feeder includes a sheet platen, a pickup roller, a feeding roller, a regulating portion, a driving mechanism, a feeding control unit, a sheet sensor, and a determination processing unit. The feeding control unit executes a feeding operation by rotationally driving the pickup roller and the feeding roller in a state where the regulating portion is located at a retreating position. The sheet sensor is located at a downstream side in the feeding direction of the feeding roller. The determination processing unit determines whether the sheet feeding has succeeded or not based on a signal from the sheet sensor. After a start of the feeding operation, when the determination processing unit determines that the sheet feeding has failed, the feeding control unit once moves the regulating portion located at the retreating position to the abutting position and then executes the feeding operation again.

4 Claims, 7 Drawing Sheets

SHEET FEEDER THAT ENSURES EXECUTION OF SHEET FEEDING WITH MORE CERTAINTY BY FEEDING RETRY PROCESS AND IMAGE PROCESSING APPARATUS INCLUDING THE SAME

INCORPORATION BY REFERENCE

This application is based upon, and claims the benefit of priority from, corresponding Japanese Patent Application No. 2016-081735 filed in the Japan Patent Office on Apr. 15, 2016, the entire contents of which are incorporated herein by reference.

BACKGROUND

Unless otherwise indicated herein, the description in this section is not prior art to the claims in this application and is not admitted to be prior art by inclusion in this section.

A typical image processing apparatus such as an image reading apparatus or an image forming apparatus includes a feeding mechanism that feeds a sheet placed on a sheet platen such as a sheet feed tray or a sheet feed cassette. At such image processing apparatus, when the feeding mechanism fails to feed the sheet, a feeding retry process that retries the sheet feeding may be executed.

In order to improve probability that the sheet feeding by the feeding retry process succeeds, the following image forming apparatus has been known; the image forming apparatus once moves down a sheet platen to release catching of a distal end of a paper sheet against a conveyance guide or similar guide, and then moves up the sheet platen again to execute the feeding retry process, when a paper sheet detector has not detected a recording paper within a predetermined period after feeding by the feeding mechanism.

SUMMARY

A sheet feeder according to one aspect of the disclosure includes a sheet platen, a pickup roller, a feeding roller, a regulating portion, a driving mechanism, a feeding control unit, a sheet sensor, and a determination processing unit. A sheet is placed on the sheet platen. The pickup roller sends out the sheet from the sheet platen in a predetermined feeding direction. The feeding roller feeds the sheet sent out by the pickup roller in the feeding direction. The regulating portion is movable between a retreating position where the regulating portion does not obstruct the conveyance of the sheet and an abutting position where the regulating portion abuts on the sheet placed on the sheet platen. The driving mechanism rotationally drives the pickup roller and the feeding roller and moves the regulating portion between the retreating position and the abutting position. The feeding control unit executes a feeding operation by rotationally driving the pickup roller and the feeding roller in a state where the regulating portion is located at the retreating position. The sheet sensor is located at a downstream side in the feeding direction of the feeding roller. The determination processing unit determines whether the sheet feeding has succeeded or not based on a signal from the sheet sensor. After a start of the feeding operation, when the determination processing unit determines that the sheet feeding has failed, the feeding control unit once moves the regulating portion located at the retreating position to the abutting position and then executes the feeding operation again.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
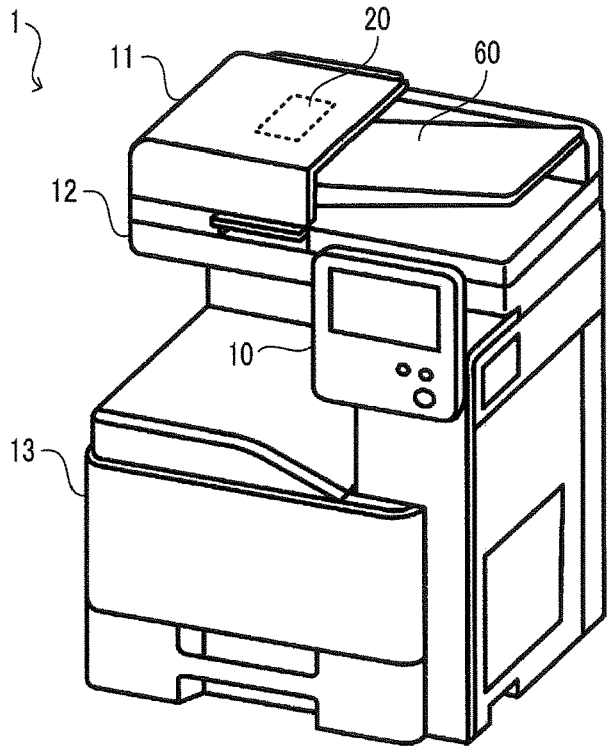
FIG. 1 illustrates an external appearance of an image processing apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure with reference to the attached drawings for understanding of the disclosure. The following embodiment is merely an exemplary embodiment according to the disclosure and does not intend to limit the technical scope of the disclosure.

Configuration of Image Forming Apparatus

Figure 2:
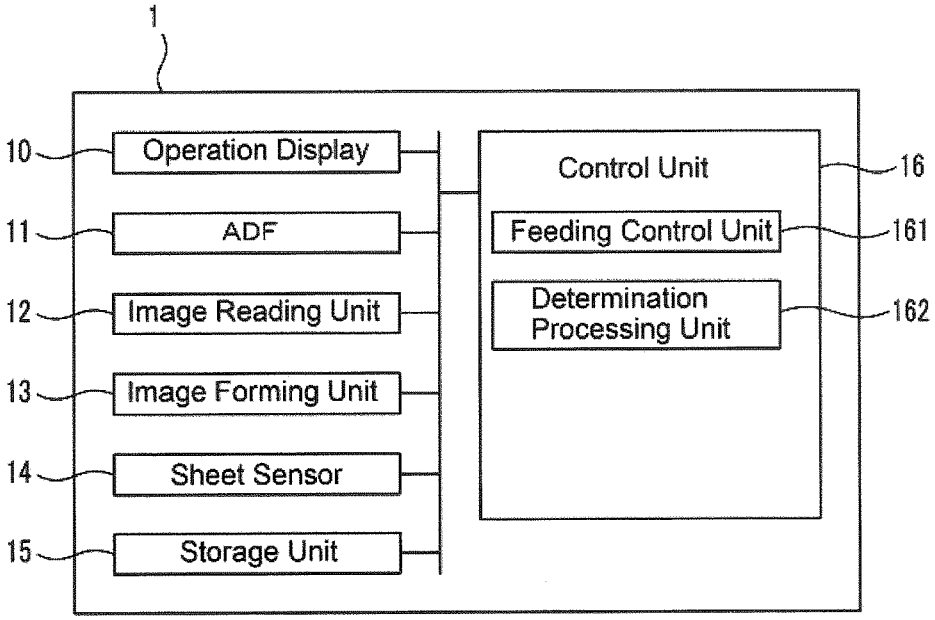
FIG. 2 illustrates a block diagram illustrating a system configuration of the image processing apparatus according to the one embodiment.

As illustrated in FIGS. 1 and 2, an image processing apparatus 1 according to the embodiment of the disclosure includes an operation display 10, an Auto Document Feeder (ADF) 11 (an exemplary sheet feeder of the disclosure), an image reading unit 12 (an exemplary image processing unit of the disclosure), an image forming unit 13 (an exemplary image processing unit of the disclosure), a sheet sensor 14, a storage unit 15, and a control unit 16. Specifically, the image processing apparatus 1 is a multi-functional peripheral including a printer function, a scanner function, a copy function, a facsimile function, and similar function. The disclosure is not limited to the multi-functional peripheral. The disclosure is applicable to any image processing apparatus including a sheet feeder that feeds a document 40 or a recording paper, such as a copying machine, a printer, and a facsimile device.

The operation display 10 includes a display such as a liquid crystal display that indicates information, and an operation unit such as a touch panel and operation buttons, that accepts user operation.

The ADF 11 is an automatic document feeder that includes a sheet platen 60, a feeding mechanism 20, a conveyance roller, a document holder, and a paper sheet discharge unit to convey the document 40 that will be a reading target of the image reading unit 12. A plurality of documents 40 (exemplary sheets of the disclosure) that will be reading targets of the image reading unit 12 are placed on the sheet platen 60 in a bundled state (see FIG. 6). The detail of the feeding mechanism 20 will be described later.

The image reading unit 12 includes a platen, a light source, a mirror, an optical lens, and a Charge Coupled Device (CCD) to ensure reading an image of the document 40 to output as image data.

The image forming unit 13 ensures executing a printing process based on the image data in an electrophotographic method or an Inkjet printing method to form an image on a sheet based on the image data. For example, when the image forming unit 13 is an image forming unit in the electrophotographic method, the image forming unit 13 includes, for example, a photoreceptor drum, a charger, an exposure apparatus, a developing device, a transfer apparatus, and a fixing unit.

Figure 6:
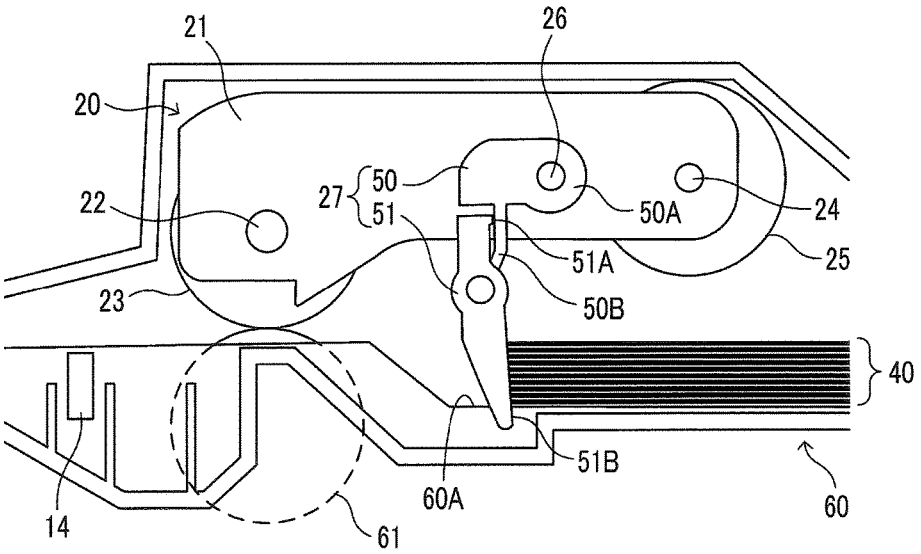
FIG. 6 illustrates a schematic diagram for describing operation of the feeding mechanism according to the one embodiment.

The sheet sensor 14 is a sensor that ensures detecting a sheet fed at the ADF 11 (see FIG. 6).

The storage unit 15 is a non-volatile storage unit such as a hard disk or EEPROM (registered trademark). The storage unit 15 stores, for example, various control programs executed by the control unit 16, and various data.

The control unit 16 includes control equipment such as a CPU, a ROM, and a RAM. The CPU is a processor that executes various arithmetic processing. The ROM is a non-volatile storage unit that preliminarily stores information such as control programs in order to cause the CPU to execute various processes. The RAM is a volatile or non-volatile storage unit used as a temporary storage memory (a work area) of the various processes that the CPU executes.

Specifically, the control unit 16 includes a feeding control unit 161 and a determination processing unit 162. The detail of the feeding control unit 161 and the determination processing unit 162 will be described later. The control unit 16 executes the various processes in accordance with the control programs to function as their respective processing units.

Configuration of Feeding Mechanism

The following describes the detail of the feeding mechanism 20 included in the ADF 11.

Figure 3:
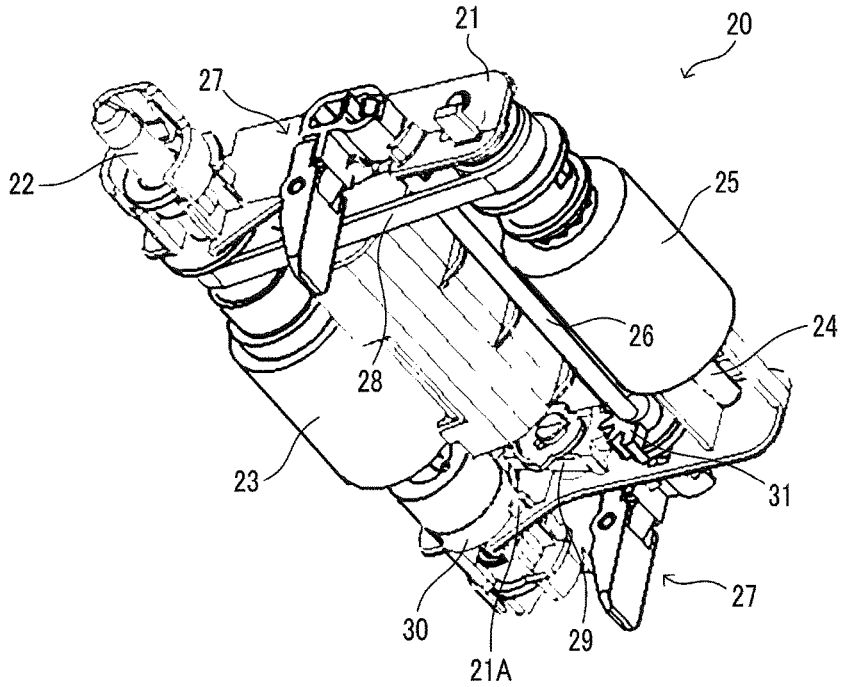
FIG. 3 obliquely illustrates a configuration of a feeding mechanism according to the one embodiment.

The feeding mechanism 20 feeds the sheet placed on the sheet platen 60 into the ADF 11. As illustrated in FIG. 3, the feeding mechanism 20 includes a drive shaft 22 (an exemplary drive shaft of the disclosure), a feeding roller 23, a rotation shaft 24, a pickup roller 25, and a frame 21 that supports them.

The frame 21 is rotatably supported to the drive shaft 22. Specifically, the drive shaft 22 supports an end portion at a downstream side in a feeding direction (a left-side end portion in FIG. 6) at the frame 21. The rotation shaft 24 is rotatably supported to an end portion at an upstream side in the feeding direction (a right-side end portion in FIG. 6) at the frame 21. The pickup roller 25 is integrally supported to the rotation shaft 24.

The drive shaft 22 transmits rotary drive power output from a driving source such as a motor (an exemplary driving unit of the disclosure). The rotation shaft 24 is connected to the drive shaft 22 via a belt 28 (an exemplary first transmission member of the disclosure). When the drive shaft 22 is rotationally driven in a predetermined direction, its rotary drive power is transmitted to the pickup roller 25 via the belt 28. This rotates the pickup roller 25 in a direction identical to that of the feeding roller 23.

Figure 4:
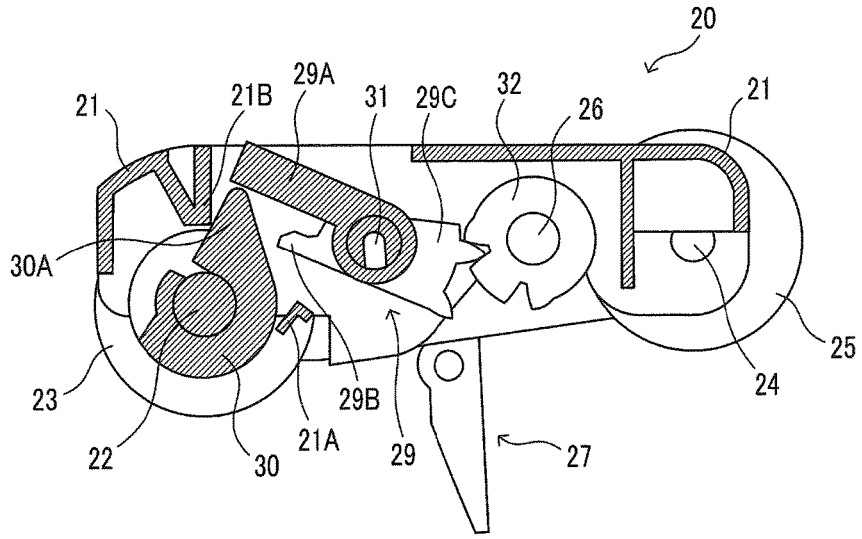
FIG. 4 schematically illustrates a configuration of a lever according to the one embodiment.
Figure 5:
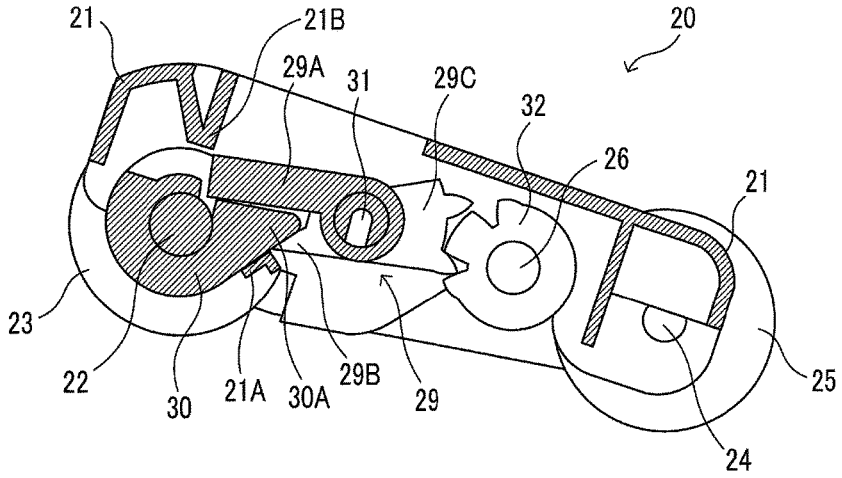
FIG. 5 schematically illustrates a configuration of the lever according to the one embodiment.

As illustrated in FIGS. 4 and 5, a cam 30 is supported to the drive shaft 22 via a torque limiter. By the torque limiter, the cam 30 integrally rotates with the drive shaft 22 while torque between the cam 30 and the drive shaft 22 is low, and the cam 30 idles with respect to the drive shaft 22 while the torque between the cam 30 and the drive shaft 22 exceeds a predetermined value.

When the drive shaft 22 is rotationally driven in a first direction (a clockwise direction in FIGS. 4 and 5), as illustrated in FIG. 5, an abutting portion 30A of the cam 30 abuts on a first protrusion 21A of the frame 21 to give power in a direction identical to the rotation direction of the drive shaft 22, to the frame 21. Therefore, as illustrated in FIG. 5, when the drive shaft 22 is rotationally driven in the clockwise direction, the frame 21 turns in the clockwise direction centering the drive shaft 22. This moves the pickup roller 25 from a standby position (a position illustrated in FIG. 6) apart from a top surface of the document 40 placed on the sheet platen 60, to a paper feeding position (a position illustrated in FIG. 7) that abuts on the top surface of the document 40 placed on the sheet platen 60. This ensures the pickup roller 25 to send out a top layer of document 40 among the bundle of documents placed on the sheet platen 60, in the feeding direction (that is, toward the feeding roller 23). The document 40 sent out by the pickup roller 25 is fed in the feeding direction by the feeding roller 23. Thus, the document 40 placed on the sheet platen 60 is fed into the ADF 11.

On the other hand, when the drive shaft 22 is rotationally driven in a second direction (a counterclockwise direction in FIGS. 4 and 5) opposite to the first direction, as illustrated in FIG. 4, the abutting portion 30A of the cam 30 abuts on a second protrusion 21B of the frame 21 to give power in a direction identical to the rotation direction of the drive shaft 22, to the frame 21. Therefore, as illustrated in FIG. 4, when the drive shaft 22 is rotationally driven in the counterclockwise direction, the frame 21 turns in the counterclockwise direction centering the drive shaft 22. This moves the pickup roller 25 to the standby position from the paper feeding position.

As illustrated in FIG. 3, the feeding mechanism 20 includes a spindle 26, a pair of regulating members 27 (exemplary regulating portions of the disclosure), and a lever 29 (an exemplary second transmission member of the disclosure).

The regulating member 27 abuts on distal end portions (that is, end portions at the downstream side in the feeding direction) of the documents 40 placed on the sheet platen 60 to regulate positions of these distal end portions. The regulating member 27 has a function that obstructs the documents 40 placed on the sheet platen 60 from abutting on the feeding roller 23 before a start of a feeding operation.

When the rotary drive power in the first direction is transmitted to the drive shaft 22, the regulating member 27 receives power from the lever 29, which is described below, to move between an abutting position (a position illustrated in FIG. 6) at which the regulating member 27 intersects with a feeding route of the documents 40 between the pickup roller 25 and the feeding roller 23, and a retreating position (a position illustrated in FIG. 7) at which the regulating member 27 retreats from the feeding route. In other words, the regulating member 27 is movable between the retreating position that does not obstruct the conveyance of the documents 40, and the abutting position that abuts on the documents 40 placed on the sheet platen 60.

Specifically, as illustrated in FIG. 6, the regulating member 27 includes a rotator 50 integrally supported to the spindle 26, and a stopper 51 (an exemplary regulating portion of the disclosure) rotatably supported by this rotator 50. The spindle 26 is rotatably supported to the frame 21. The rotator 50 includes a base portion 50A that extends from the spindle 26 to the downstream side in the feeding direction, and an arm 50B that extends below from the base portion 50A to rotatably support the stopper 51. The stopper 51 is rotatably supported by the arm 50B. The stopper 51 includes an abutting portion 51A and an abutting surface 51B.

As illustrated in FIG. 6, in a state where the stopper 51 is located at the abutting position, a lower-side end portion of the stopper 51 is located below a placement surface 60A of the sheet platen 60, and the distal end portions of the documents 40 placed on the sheet platen 60 abut on the abutting surface 51B. In this state, even if the abutting surface 51B is pressed by the documents 40, the abutting portion 51A abuts on the arm 50B. Thus, the stopper 51 no more rotate in the clockwise direction with respect to the rotator 50. In this state, as illustrated in FIG. 4, the rotation in the counterclockwise direction of the lever 29 is prevented by the cam 30. Thus, the rotator 50 does not rotate in the clockwise direction. Therefore, the documents 40 placed on the sheet platen 60 do not abut on the feeding roller 23. Accordingly, when the documents 40 are placed on the sheet platen 60 in the state where the stopper 51 is located at the abutting position, as illustrated in FIG. 6, the distal end portions of the documents 40 are regulated by the abutting surface 51B of the stopper 51.

The lever 29 transmits the rotary drive power of the drive shaft 22 to the spindle 26 to move the regulating member 27 between the abutting position and the retreating position. Specifically, as illustrated in FIGS. 4 and 5, the lever 29 includes a first projection 29A, a second projection 29B, and a gear portion 29C. The lever 29 is rotatably supported to a lever shaft 31 protruded from the frame 21.

The first projection 29A and the second projection 29B are abutted on the abutting portion 30A of the cam 30, in accordance with the rotation of the cam 30. The gear portion 29C has a plurality of gear teeth adjacently arranged in an arc shape. On the other hand, a gear 32 that integrally rotates with the spindle 26 is located at the spindle 26. The gear 32 also has a plurality of gear teeth adjacently arranged in an arc shape. The gear portion 29C and the gear 32 are oppositely arranged such that the respective gear teeth are meshed. Consequently, when the lever 29 turns centering the lever shaft 31, in accordance with this, the spindle 26 rotates.

When the drive shaft 22 is rotationally driven in the first direction (the clockwise direction in FIGS. 4 and 5), as illustrated in FIG. 5, the abutting portion 30A of the cam 30 abuts on the second projection 29B of the lever 29 to turn the lever 29 in the counterclockwise direction. As a result, the spindle 26 rotates in the clockwise direction to turn the rotator 50 of the regulating member 27 in the clockwise direction. Thus, the regulating member 27 moves from the abutting position to the retreating position.

On the other hand, when the drive shaft 22 is rotationally driven in the second direction (the counterclockwise direction in FIGS. 4 and 5), as illustrated in FIG. 4, the abutting portion 30A of the cam 30 abuts on the first projection 29A of the lever 29 to turn the lever 29 in the clockwise direction. As a result, the spindle 26 rotates in the counterclockwise direction to turn the rotator 50 of the regulating member 27 in the counterclockwise direction. Thus, the regulating member 27 moves from the retreating position to the abutting position.

Thus, as the drive shaft 22 of the feeding roller 23 rotates in the first direction, the feeding mechanism 20 moves the pickup roller 25 to the paper feeding position and moves the regulating member 27 to the retreating position. As the drive shaft 22 of the feeding roller 23 rotates in the second direction, the feeding mechanism 20 moves the pickup roller 25 to the standby position and moves the regulating member 27 to the abutting position. That is, the feeding mechanism 20 is configured such that, in conjunction with movement in which the pickup roller 25 moves from the paper feeding position to the standby position, the regulating member 27 moves from the retreating position to the abutting position.

More specifically, as the drive shaft 22 of the feeding roller 23 is rotationally driven in the first direction by the rotary drive power of the motor, the frame 21 is turned in the first direction by the cam 30 to move the pickup roller 25 to the paper feeding position, and the spindle 26 is rotated in the first direction by the cam 30 and the lever 29 to move the regulating member 27 to the retreating position.

As the drive shaft 22 of the feeding roller 23 is rotationally driven in the second direction by the rotary drive power of the motor, the frame 21 is turned in the second direction by the cam 30 to move the pickup roller 25 to the standby position, and the spindle 26 is rotated in the second direction by the cam 30 and the lever 29 to move the regulating member 27 to the abutting position.

The frame 21, the spindle 26, the rotation shaft 24, the belt 28, the lever 29, and the cam 30 are an exemplary driving mechanism of the disclosure. These configurations rotationally drive the pickup roller 25 and the feeding roller 23, and move the regulating member 27 between the abutting position and the retreating position.

Feeding Operation

Figure 7:
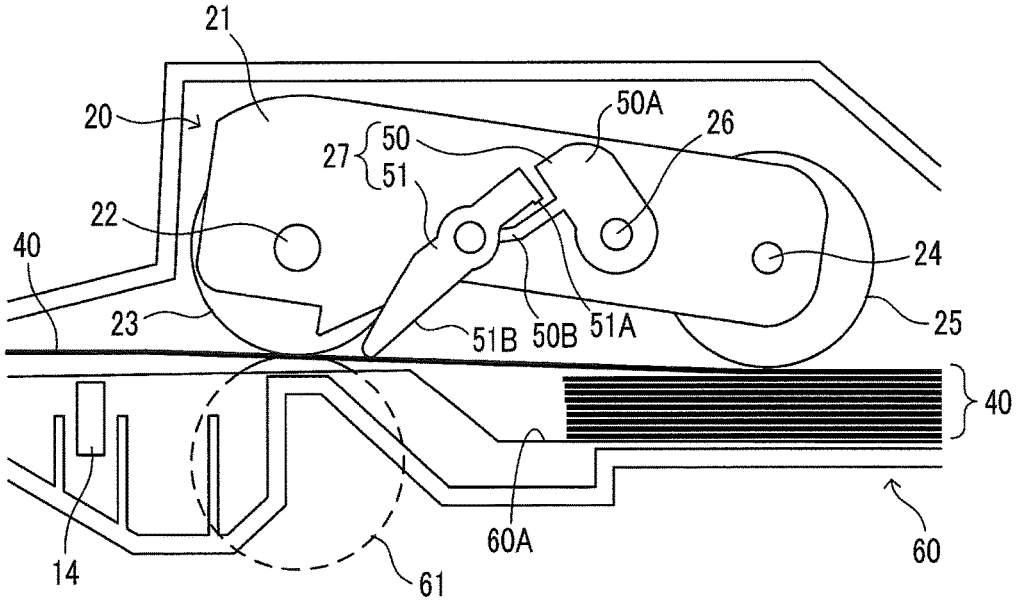
FIG. 7 illustrates a schematic diagram for describing the operation of the feeding mechanism according to the one embodiment.

The following describes the feeding operation of the image processing apparatus 1 with reference to FIGS. 6 and 7.

FIG. 6 illustrates a state of the feeding mechanism 20 before executing the feeding operation. Before executing the feeding operation, the pickup roller 25 is located at the standby position, and the regulating member 27 is located at the abutting position. In this state, the positions of the distal end portions of the documents 40 placed on the sheet platen 60 is regulated by the stopper 51.

The feeding control unit 161 of the control unit 16 executes the feeding operation that rotationally drives the pickup roller 25 and the feeding roller 23 in a state where the stopper 51 is located at the retreating position. Specifically, the feeding control unit 161 drives the motor with normal rotation. This rotates the drive shaft 22 in the first direction. Corresponding to this, the pickup roller 25 moves to the paper feeding position, and the regulating member 27 moves to the retreating position. Then, as illustrated in FIG. 7, the top layer of document 40 among the documents 40 placed on the sheet platen 60 is sent out by the pickup roller 25, and further, this document 40 is fed into the ADF 11 by the feeding roller 23.

A separation roller 61 is arranged at a position opposed to the feeding roller 23. When multi feeding of the documents 40 from the pickup roller 25 occurs, the separation roller 61 separates only the top layer of document 40 among the documents 40 to feed.

Feeding Retry Process

Figure 8:
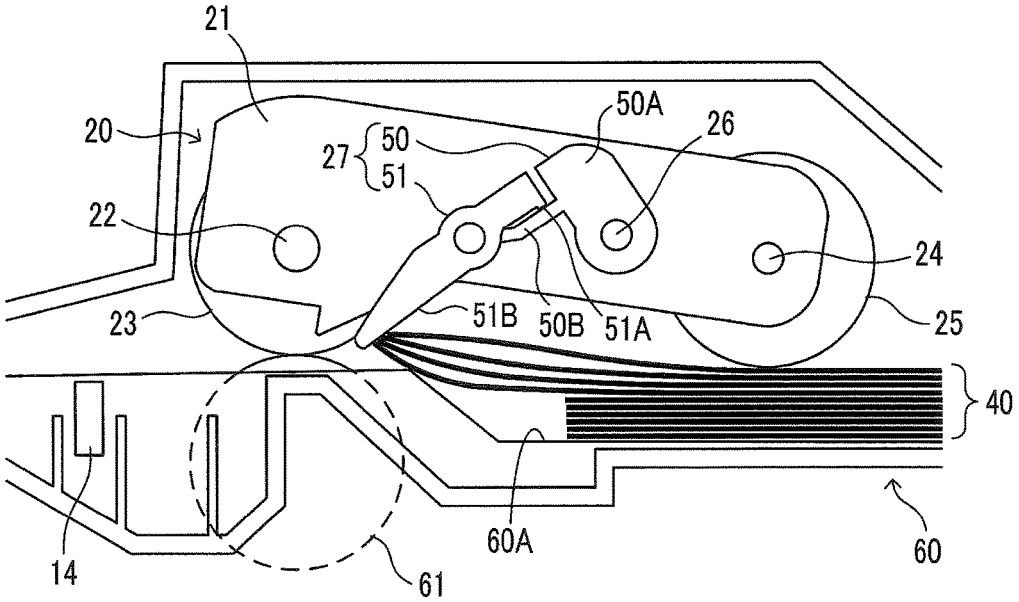
FIG. 8 illustrates a schematic diagram for describing the operation of the feeding mechanism according to the one embodiment.
Figure 9:
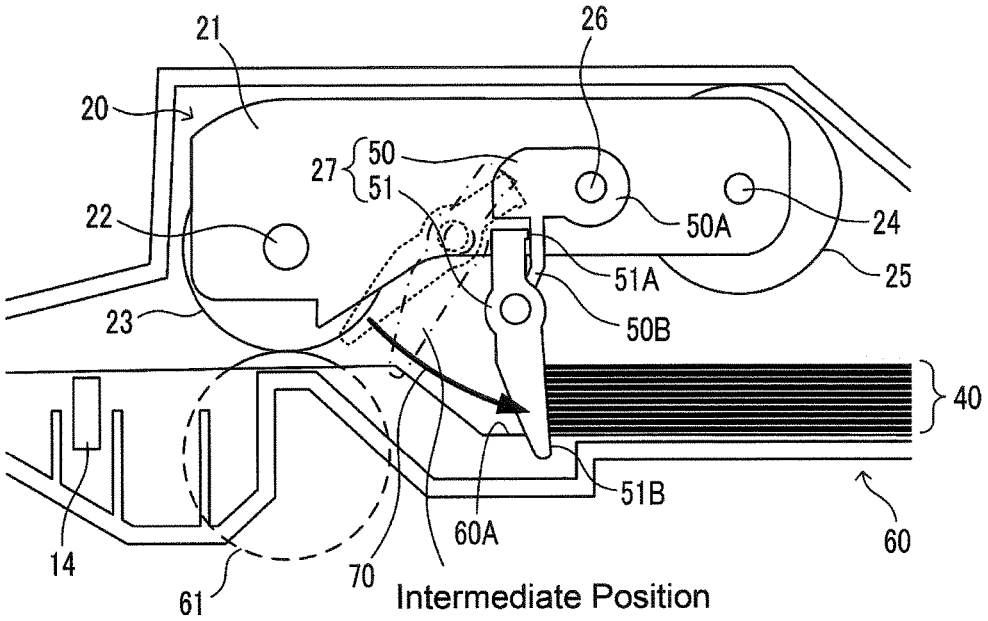
FIG. 9 illustrates a schematic diagram for describing the operation of the feeding mechanism according to the one embodiment.
Figure 10:
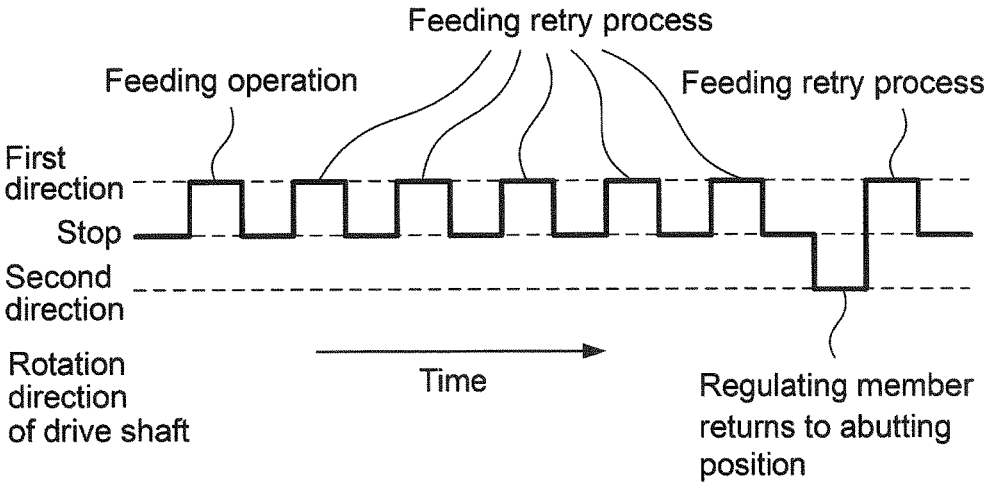
FIG. 10 illustrates an exemplary feeding control process executed at the image processing apparatus according to the one embodiment.

The following describes a feeding retry process executed at the image processing apparatus 1 with reference to FIGS. 8 to 10. Here, the feeding retry process is a process that executes the feeding operation again, when detecting that the feeding of the document 40 by the feeding operation has failed.

The sheet sensor 14 is arranged at the downstream side in the feeding direction of the feeding roller 23. The determination processing unit 162 of the control unit 16 determines whether the feeding roller 23 has succeeded to feed the document 40 or not based on a signal from the sheet sensor 14. Specifically, the determination processing unit 162 determines that the feeding of the document 40 has succeeded when the sheet sensor 14 had detected the document 40 before a predetermined period had passed from the start of the feeding operation. On the other hand, the determination processing unit 162 determines that the feeding of the document 40 has failed when the sheet sensor 14 had not detected the document 40 even if the predetermined period had passed from the start of the feeding operation. For example, when the multi feeding of the documents 40 from the pickup roller 25 occurs to be in a state as illustrated in FIG. 8, even if the pickup roller 25 is rotationally driven, the document 40 does not reach a nip portion between the feeding roller 23 and the separation roller 61. Thus, the feeding of the document 40 fails.

When the determination processing unit 162 has determined that the feeding of the document 40 had failed, the feeding control unit 161 of the control unit 16 executes the feeding retry process.

Now, it is considered that in order to improve probability that the feeding retry process succeeds to feed the document 40, for example, a mechanism that moves up and down the sheet platen 60 is located, and after the feeding operation, when the sheet sensor 14 has not detected the document 40 within the predetermined period, this mechanism once moves down the sheet platen 60 to release catching of the document 40 against a conveyance guide or similar guide, and then moves up the sheet platen 60 again and then executes the feeding retry process. However, in this case, even if moving down the sheet platen 60, the catching of the document 40 may not be released. Such case is determined as a jam to terminate the feeding control. In contrast, at the image processing apparatus 1 according to the embodiment, the feeding control unit 161 executes the feeding retry process as described later to ensure executing the feeding of the sheet with more certainty.

After the start of the feeding operation, the feeding control unit 161 once moves the regulating member 27 located at the retreating position to the abutting position and then executes the feeding retry process, when the determination processing unit 162 has determined that the feeding of the document 40 had failed. For example, after the start of the feeding operation, the feeding control unit 161 first, repeats the feeding retry process a preliminary determined number of times (for example, five times), when the determination processing unit 162 has determined that the feeding of the document 40 had failed. Then, in spite of it, when the determination processing unit 162 has determined that the feeding of the document 40 had failed, the feeding control unit 161 once moves the regulating member 27 located at the retreating position to the abutting position and then executes the feeding retry process.

FIG. 10 illustrates one exemplary of the feeding retry process by the feeding control unit 161. When the sheet sensor 14 does not detect the document 40 even if the predetermined period has passed from the start of the feeding operation, first, the feeding control unit 161 executes the feeding retry process five times. An interval of the respective feeding retry processes is, for example, 400 msecs. In this period, the drive shaft 22 is not rotationally driven in the second direction. Thus, the position of the pickup roller 25 remains the paper feeding position, and the position of the regulating member 27 remains the retreating position.

When the feeding of the document 40 does not succeed even if the feeding retry process is executed five times, the feeding control unit 161 rotationally drives the drive shaft 22 in the second direction. This returns the pickup roller 25 to the standby position and returns the regulating member 27 to the abutting position. At this time, as denoted by an arrow 70 illustrated in FIG. 9, the stopper 51 of the regulating member 27 moves in a direction opposite to the feeding direction along the feeding route, from the retreating position, through an intermediate position that intersects with the feeding route, to reach the abutting position. Here, the intermediate position is a position denoted by an alternate long and short dash line in FIG. 9, and a position that intersects with the feeding route at the downstream side in the feeding direction of the abutting position. As a result, the stopper 51 pushes the document 40 back in the direction opposite to the feeding direction to change a posture of the document 40 from a state where the feeding of the document 40 has been failed (for example, the state as illustrated in FIG. 8). At this time, the pickup roller 25 has returned to the standby position. Thus, the stopper 51 can easily pushes the document 40 back. Afterwards, the feeding control unit 161 rotationally drives the drive shaft 22 in the first direction again and then executes the feeding retry process.

Figure 11:
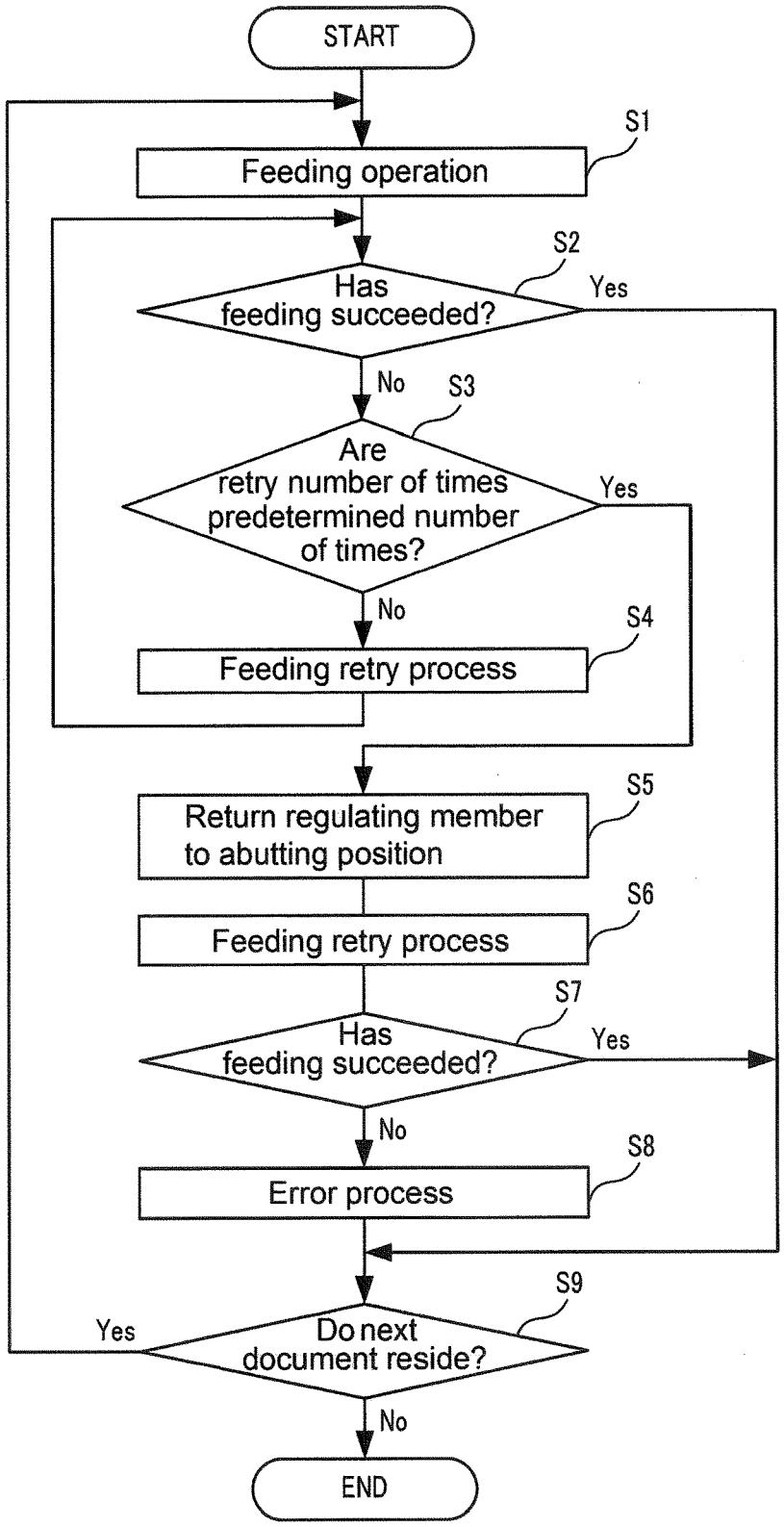
FIG. 11 illustrates an exemplary procedure of the feeding control process executed at the image processing apparatus according to the one embodiment.

The following describes an exemplary procedure of a feeding control process executed by the control unit 16 with reference to FIG. 11. Here, Steps S1, S2, . . . , indicate the number of procedures (steps) executed by the control unit 16. The feeding control process starts, for example, corresponding to detection of a predetermined image reading start operation with respect to the operation display 10.

Step S1

First, at Step S1, the control unit 16 executes the feeding operation. Specifically, the control unit 16 drives the motor with normal rotation to rotate the drive shaft 22 in the first direction. This rotates the feeding roller 23 and the pickup roller 25.

Step S2

At Step S2, the control unit 16 determines whether the feeding roller 23 has succeeded to feed the document 40 or not. For example, the control unit 16 determines that the feeding of the document 40 has succeeded when the sheet sensor 14 had detected the document 40 until when the predetermined period had passed from the start of the feeding operation at Step S1, and determines that the feeding of the document 40 has failed when the sheet sensor 14 had not detected the document 40 even if the predetermined period had passed from the start of the feeding operation. Then, when determining that the feeding of the document 40 has succeeded (Step S2: Yes), the process moves to Step S9. On the other hand, when determining that the feeding of the document 40 has failed (Step S2: No), the process moves to Step S3.

Step S3

At Step S3, the control unit 16 determines whether retry number of times, which are the number of times of execution of the feeding retry process, have reached the predetermined number of times (for example, five times) or not. Specifically, the control unit 16 determines whether the retry number of times have reached the predetermined number of times or not, based on the retry number of times stored in the RAM. Then, when determining that the retry number of times have reached the predetermined number of times (Step S3: Yes), the process moves to Step S5. On the other hand, when determining that the retry number of times have not reached the predetermined number of times (Step S3: No), the process moves to Step S4.

Step S4

At Step S4, the control unit 16 executes the feeding retry process. Specifically, the control unit 16 drives the motor with normal rotation to rotate the drive shaft 22 in the first direction. This rotates the feeding roller 23 and the pickup roller 25. Then, the process returns to Step S2. The number of times of the feeding retry process executed at Step S4 is stored in the RAM as the retry number of times.

Step S5

At Step S5, the control unit 16 returns the regulating member 27 to the abutting position. Specifically, the control unit 16 drives the motor with inverse rotation to rotate the drive shaft 22 in the second direction. This returns the pickup roller 25 to the standby position and returns the regulating member 27 to the abutting position. Consequently, the regulating member 27 pushes the document 40 back at the upstream side in the feeding direction to change the posture of the document 40.

Step S6

At Step S6, the control unit 16 executes the feeding retry process. Specifically, the control unit 16 drives the motor with normal rotation to rotate the drive shaft 22 in the first direction. This returns the pickup roller 25 to the paper feeding position and returns the regulating member 27 to the retreating position, and then, the feeding roller 23 and the pickup roller 25 feed the document 40.

Step S7

At Step S7, the control unit 16 determines whether the feeding roller 23 has succeeded to feed the document 40 or not. For example, the control unit 16 determines that the feeding of the document 40 has succeeded when the sheet sensor 14 had detected the document 40 until when the predetermined period had passed from the start of the feeding operation at Step S6, and determines that the feeding of the document 40 has failed when the sheet sensor 14 had not detected the document 40 even if the predetermined period had passed from the start of the feeding operation. Then, when determining that the feeding of the document 40 has succeeded (Step S7: Yes), the process moves to Step S9. On the other hand, when determining that the feeding of the document 40 has failed (Step S7: No), the process moves to Step S8.

Step S8

At Step S8, the control unit 16 executes an error process. For example, the control unit 16 displays the fact that the document 40 could not normally fed, on the operation display 10 and displays a message that asks a user to reset the document 40, on the operation display 10. Afterwards, when detecting a predetermined restart operation with respect to the operation display 10, the process moves to Step S9.

Step S9

At Step S9, the control unit 16 determines whether the next document 40 to be fed resides on the sheet platen 60 or not. For example, the control unit 16 determines whether the next document 40 resides or not based on a signal from a sheet sensor (not illustrated) located at the sheet platen 60. Then, when determining that the next document 40 resides (Step S9: Yes), the process returns to Step S1, and then, the feeding operation of the next document 40 is executed. On the other hand, when determining that the next document 40 does not reside (Step S9: No), the feeding control process terminates.

The processes at Steps S1, S3 to S6 are executed by the feeding control unit 161 of the control unit 16. The processes at Steps S2 and S7 are executed by the determination processing unit 162 of the control unit 16.

As described above, the image processing apparatus 1 according to the embodiment once returns the regulating member 27 to the abutting position to change the posture of the document 40, and then executes the feeding retry process. Thus, this ensures executing the feeding of the document 40 by the feeding retry process with more certainty.

Figure 12:
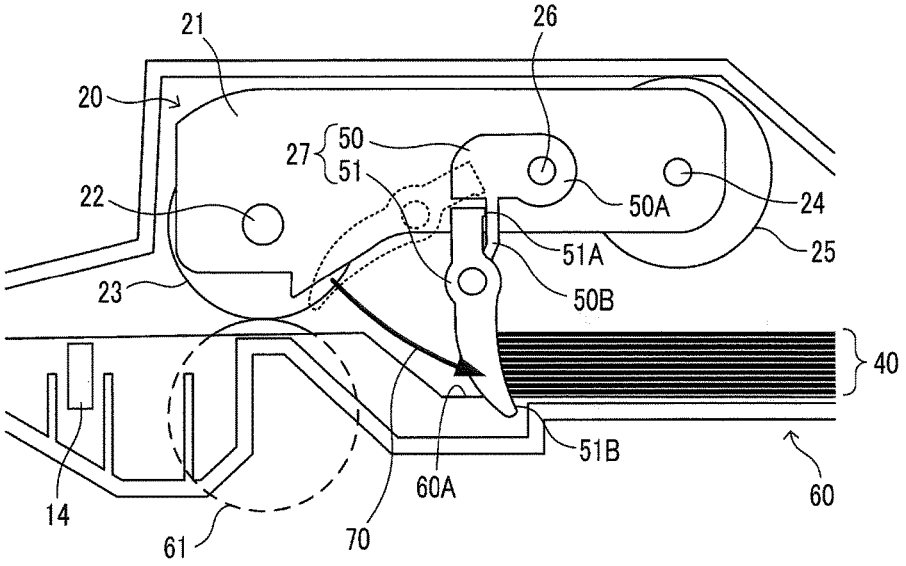
FIG. 12 illustrates a modification of a stopper according to the one embodiment.

In this embodiment, for example, as illustrated in FIG. 6, the abutting surface 51B of the stopper 51 is flat. However, the disclosure is not limited to this. For example, as illustrated in FIG. 12, the abutting surface 51B of the stopper 51 may be depressed-shaped. This makes the distal end portion of the document 40 less likely to slip from the abutting surface 51B when the stopper 51 returns to the abutting position, to facilitate to return the document 40 to an original position. Here, the abutting surface 51B is a surface at the upstream side in the feeding direction of the stopper 51 in a state located at the abutting position. As an object to obtain similar advantageous effect, processing that enhances friction force may be performed on the abutting surface 51B, for example, by making the abutting surface 51B of the stopper 51 a rough surface, or by laminating a member with high friction force on the abutting surface 51B of the stopper 51. In this case, in order to prevent the distal end of the document 40 from being caught on the abutting surface 51B of the stopper 51 in the feeding of the document 40, it is preferable that the retreating position is located at a position where the distal end of the document 40 does not contact the abutting surface 51B of the stopper 51 in the feeding of the document 40.

In this embodiment, when determining that the feeding of the document 40 has failed, the regulating member 27 is once moved to the abutting position after executing the feeding retry process the predetermined number of times. However, the disclosure is not limited to this. In another embodiment, when determining that the feeding of the document 40 has failed, the feeding retry process may be executed after the regulating member 27 is immediately once moved to the abutting position. However, when avoiding noise such that the frame 21 hits against a housing of the ADF 11 when the regulating member 27 returns to the abutting position, as much as possible, as the above-described embodiment, it can be said more preferable that the regulating member 27 is once moved to the abutting position after executing the feeding retry process the predetermined number of times.

In this embodiment, the feeding mechanism 20 for feeding the document 40 to the ADF 11 has been described. However, the disclosure is not limited to this. For example, the disclosure is also applicable to a feeding mechanism for feeding a recording sheet housed in a sheet feed cassette located at the image forming unit 13.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet feeder comprising:

a sheet platen on which a sheet is placed;

a pickup roller that sends out the sheet from the sheet platen in a predetermined feeding direction;

a feeding roller that feeds the sheet sent out by the pickup roller in the feeding direction;

a feeding route of the sheet positioned between the pickup roller and the feeding roller;

a regulating portion movable between a retreating position where the regulating portion does not obstruct the conveyance of the sheet and an abutting position where the regulating portion abuts on the sheet placed on the sheet platen through an intermediate position which is a position that intersects with the feeding route at the downstream side in the feeding direction of the abutting position;

a driving mechanism that rotationally drives the pickup roller and the feeding roller and moves the regulating portion between the retreating position and the abutting position;

a feeding control unit that executes a feeding operation by rotationally driving the pickup roller and the feeding roller in a state where the regulating portion is located at the retreating position;

a sheet sensor located at a downstream side in the feeding direction of the feeding roller; and a determination processing unit that determines whether the sheet feeding has succeeded or not based on a signal from the sheet sensor, wherein after a start of the feeding operation, when the determination processing unit determines that the sheet feeding has failed, the feeding control unit once moves the regulating portion located at the retreat position in a direction opposite to the feeding direction through the intermediate position and temporarily moves the regulating portion to the abutting position so as to pushes the sheet back in the direction opposite to the feeding direction and then executes the feeding operation again, the pickup roller is movable between a paper feeding position where the pickup roller abuts on a top surface of the sheet placed on the sheet platen and a standby position apart from the top surface of the sheet placed on the sheet platen, the driving mechanism moves the regulating portion from the retreating position to the abutting position in conjunction with movement in which the pickup roller moves from the paper feeding position to the standby position, the driving mechanism is configured such that as a drive shaft of the feeding roller rotates in a first direction, the pickup roller moves to the paper feeding position while the regulating portion moves to the retreating position, and as the drive shaft of the feeding roller rotates in a second direction opposite to the first direction, the pickup roller moves to the standby position while the regulating portion moves to the abutting position, the driving mechanism includes:

a frame turnably supported to the drive shaft of the feeding roller;

a spindle rotatably supported to a part at the upstream side in the feeding direction of the drive shaft of the feeding roller at the frame, so as to support the regulating portion;

a rotation shaft rotatably supported to a part at the upstream side in the feeding direction of the spindle at the frame, so as to support the pickup roller;

a first transmission member that transmits a rotary drive power of the drive shaft of the feeding roller to the rotation shaft;

a second transmission member that transmits a rotary drive power of the drive shaft of the feeding roller to the spindle; and a cam supported to the drive shaft of the feeding roller, the sheet feeder is configured such that as the rotary drive power output from the driving unit rotationally drives the drive shaft of the feeding roller in the first direction, the frame is turned in the first direction by the cam so as to move the pickup roller to the paper feeding position, and the spindle is rotated in the first direction by the cam and the second transmission member, so as to move the regulating portion to the retreating position, and the sheet feeder is configured such that as the rotary drive power output from the driving unit rotationally drives the drive shaft of the feeding roller in the second direction, the frame is turned in the second direction by the cam so as to move the pickup roller to the standby position, and the spindle is rotated in the second direction by the cam and the second transmission member, so as to move the regulating portion to the abutting position.

2. The sheet feeder according to claim 1, wherein after the start of the feeding operation, when the determination processing unit determines that the sheet feeding has failed in spite of repeating the feeding operation a predetermined number of times, the feeding control unit once moves the regulating portion located at the retreating position to the abutting position and then executes the feeding operation again.

3. The sheet feeder according to claim 1, wherein a surface in contact with the sheet at an upstream side in the feeding direction of the regulating portion in a state located at the abutting position is depressed-shaped.

4. An image processing apparatus comprising:

the sheet feeder according to claim 1; and an image processing unit that includes at least one of: an image reading unit that reads an image of a sheet fed by the sheet feeder, and an image forming unit that forms an image on a sheet fed by the sheet feeder.

* * * * *